US005586777A

United States Patent [19]

Wolf

[11] Patent Number: 5,586,777

[45] Date of Patent: Dec. 24, 1996

[54] IN LINE SKATE WITH DYNAMICALLY ADJUSTABLE WHEELS

[76] Inventor: David Wolf, 67 Brackett Rd., Newton, Mass. 02158

[21] Appl. No.: 462,829

[22] Filed: Jun. 5, 1995

[51] Int. Cl.[6] ..... A63C 17/04

[52] U.S. Cl. ..... 280/11.22; 280/11.27

[58] Field of Search ..... 280/11.19, 11.22, 280/11.23, 11.26, 11.27, 11.28, 9, 10, 7.13, 43.17, 43.22

[56] References Cited

U.S. PATENT DOCUMENTS

| | | | |
|---|---|---|---|
| 576,106 | 2/1897 | Frankenberg et al. . | |
| 1,068,829 | 7/1913 | Szymanski . | |
| 1,534,601 | 4/1925 | Matveveff . | |
| 1,609,612 | 12/1926 | Eskeland | 280/11.22 |
| 1,790,423 | 1/1931 | Hooks . | |
| 1,880,915 | 10/1932 | Dyer . | |
| 1,975,905 | 10/1934 | Specht | 280/11.22 |
| 2,145,219 | 1/1939 | Burton . | |
| 2,558,311 | 6/1951 | Morrow . | |
| 2,644,692 | 7/1953 | Kahlert | 280/11.22 |
| 3,649,828 | 3/1972 | Price . | |
| 3,884,485 | 5/1975 | Walle . | |
| 4,394,028 | 7/1983 | Wheelwright | 280/11.28 |
| 4,909,523 | 5/1990 | Olson . | |
| 5,046,746 | 9/1991 | Gierveld . | |
| 5,092,614 | 3/1992 | Malewicz . | |
| 5,135,244 | 8/1992 | Allison | 280/11.28 |
| 5,253,884 | 10/1993 | Landers . | |
| 5,330,208 | 7/1994 | Charron et al. | 280/11.27 |
| 5,374,072 | 12/1994 | Landers . | |
| 5,486,011 | 1/1996 | Nelson | 280/11.22 |

FOREIGN PATENT DOCUMENTS

| | | | |
|---|---|---|---|
| 277009 | 3/1915 | Germany . | |
| 67893 | 4/1951 | Netherlands . | |
| 1402028 | 8/1975 | United Kingdom | 280/11.22 |
| 93/12847 | 7/1993 | WIPO | 280/11.22 |

*Primary Examiner*—Brian L. Johnson
*Assistant Examiner*—Min Yu
*Attorney, Agent, or Firm*—Wolf, Greenfield & Sacks, P.C.

[57] ABSTRACT

An in-line skate having a plurality of aligned wheels which are secured and supported on the bottom of an in-line skate boot by a pair of axle supports. The axle supports extend longitudinally of the skate boot. One of the axle supports is secured directly to the skate boot. The other axle support is secured to and slides with respect to the other axle support. The wheels, each carried by an axle, are positioned within the inner axle support and are secured to the axle supports by axles that pass through aligned slots in the two supports. The slots in the axle supports are arranged to cause vertical movement of at least one, and preferably two, of the wheels when one axle support is moved relative to the other.

9 Claims, 2 Drawing Sheets

IN LINE SKATE WITH DYNAMICALLY ADJUSTABLE WHEELS

SUBJECT MATTER OF THE INVENTION

The present invention relates to a means for dynamically adjusting at least one, and preferably two, of the wheels of an in-line skate, relative to the others, for purposes of affecting the function of the skate.

BACKGROUND OF THE PRESENT INVENTION

Ideally, skates made for in-line speed skating and skates made for in-line figure skating are different. For speed skating, in-line skates preferably have four or more wheels aligned longitudinally for even distribution of weight along the entire length of the in-line skate. For in-line figure skating, on the other hand, it is preferable to have fewer wheels engage the surface in such arrangements. Fewer wheels permit quick turns and other maneuvers common to in-line figure skating, but not needed for in-line speed skating. Heretofore, efforts have been made to design in-line skates that are normally used for speed skating to be adapted for figure skating. In these efforts, the center two wheels of a four-wheel skate are supported on hinged axles that permit the center wheel or wheels to be lowered below the level of the outer wheels, thus effectively changing the skate from one in which, for example, four wheels engage the surface to one in which two wheels engage the surface. These adjustable skates, however, all require the manual operation of the lever system to permit the vertical adjustment of the centermost wheels. These manual adjustments, in turn, mean the skater must stop and adjust the skates to change from one mode of operation to the other.

OBJECT OF THE PRESENT INVENTION

It is a principal object of the present invention to provide an improved means and method for adjusting an in-line skate for use as a racing skate or, alternately, for use as a figure skate.

A further object of the present invention is to provide an improved in-line rollerskate design, in which the skate may be dynamically adjusted to convert the wheel arrangement between uses for figure skating and speed skating.

A further object of the present invention is to provide a means for dynamically converting a speed skate to a figure skate, using simple arrangements that are not likely to fail, are easy to manufacture, and may be produced comparatively inexpensively.

SUMMARY OF THE PRESENT INVENTION

The present invention provides an improved in-line skate, having a plurality of aligned wheels and axles, with means for selectively shifting the axle of at least one, and preferably two, of the plurality of wheels, to and from a position below the other axles of the plurality of wheels, with the means for shifting formed in a position to permit the dynamic movement of the wheels while the skate is in use and moving on a surface.

DETAILED DESCRIPTION OF THE INVENTION

Figure 1:
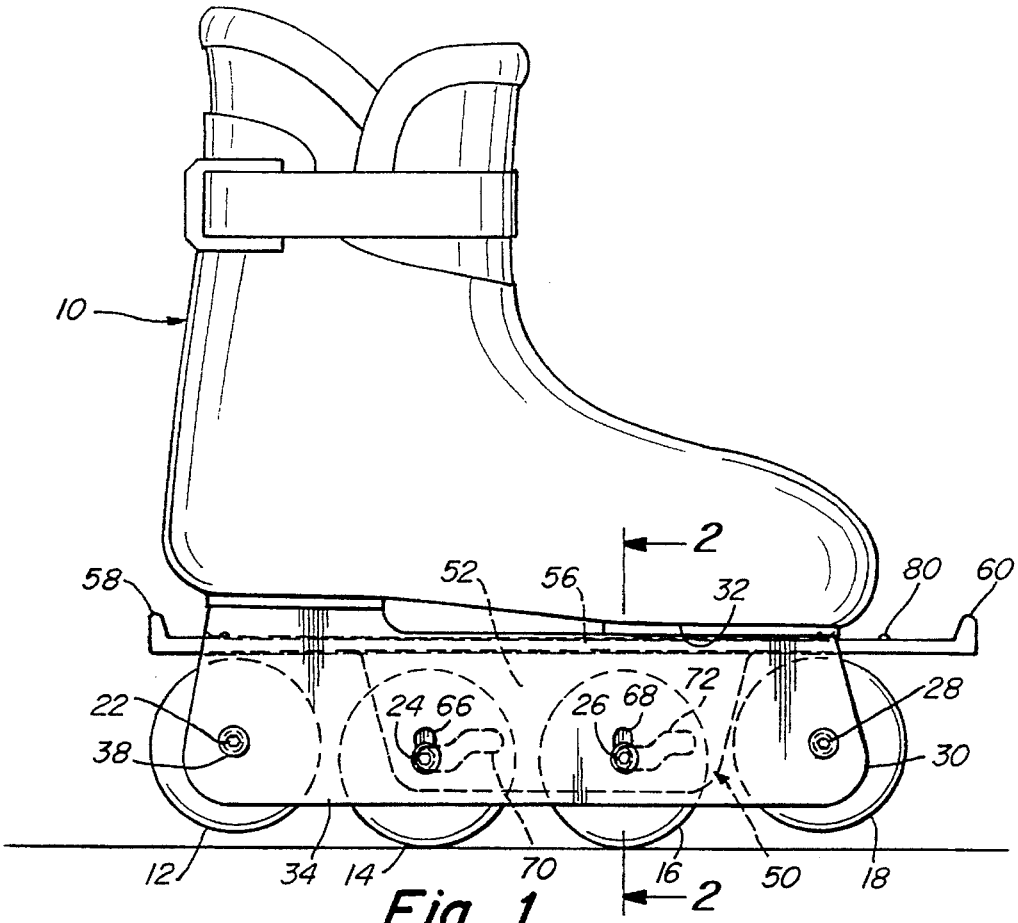
FIG. 1 is a side elevational view of an in-line skate, with the axles of the outermost wheels at a level above the axles of the lowermost wheels, and thus in a figure-skating arrangement.
Figure 3:
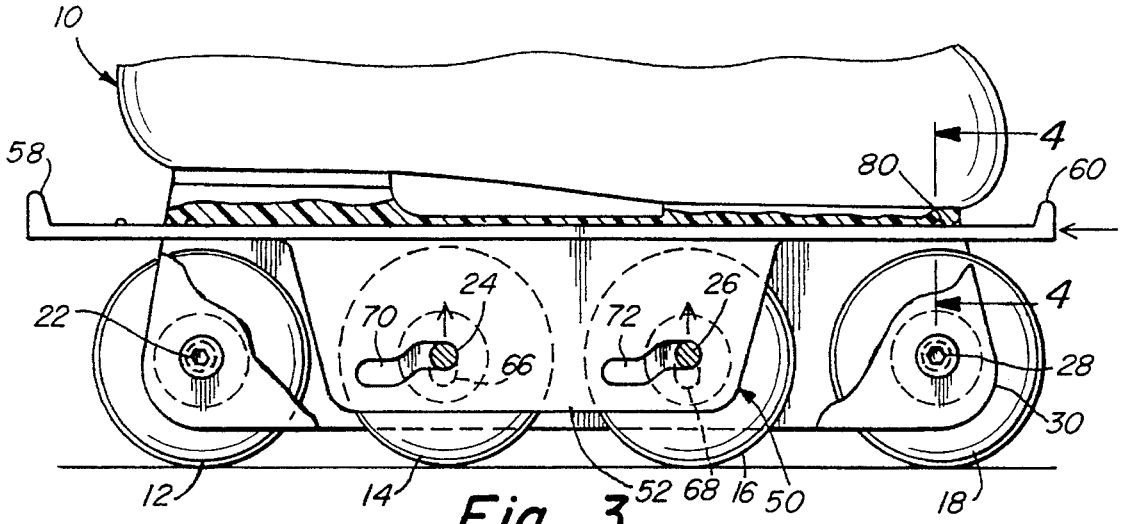
FIG. 3 is a fragmentary side elevational view, similar to FIG. 1, with all four wheels having their axles aligned with one another, and thus in a racing-skate arrangement.
Figure 4:
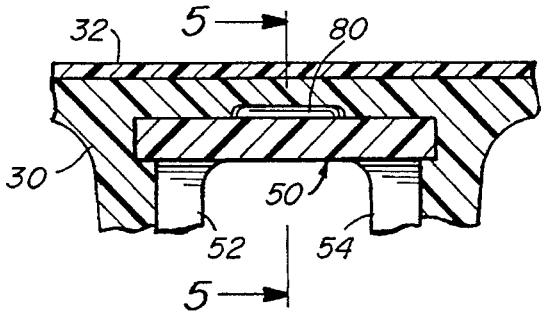
FIG. 4 is a cross-sectional view, taken along the line 4—4 of FIG. 3.
Figure 5:
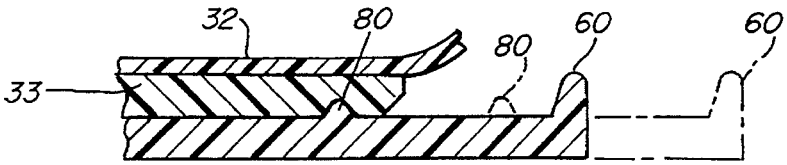
FIG. 5 is a cross-sectional view, taken along the line 5—5 of FIG. 4.

FIG. 1 illustrates a skate boot 10, having secured to it four in-line wheels 12, 14, 16 and 18, in a figure-skating orientation, while FIG. 3 shows the in-line skate boot 10 with the same wheels 12, 14, 16 and 18, in a racing-skate orientation. In the figure-skating orientation, the axles 22 and 28, respectively supporting wheels 12 and 18, are positioned in a plane higher than the plane in which the axles 24 and 26, supporting wheels 14 and 16, is located. In the racing skate orientation of FIG. 3, the wheels 12, 14, 16, and 18, and their respective axles 22, 24, 26, and 28, are all in the same plane.

Thus, in the embodiment illustrated, the wheels 12 and 18 are permanently secured for rotation in a fixed position relative to each other and to the skate boot by securing the ends of the axles 22 and 28 in the outer axle support 30. In this arrangement, an outer axle support 30 (see FIG. 2) extends lengthwise of the boot 10. The axle support 30 is permanently secured by suitable means to the bottom sole 32 of the skate boot.

Figure 2:
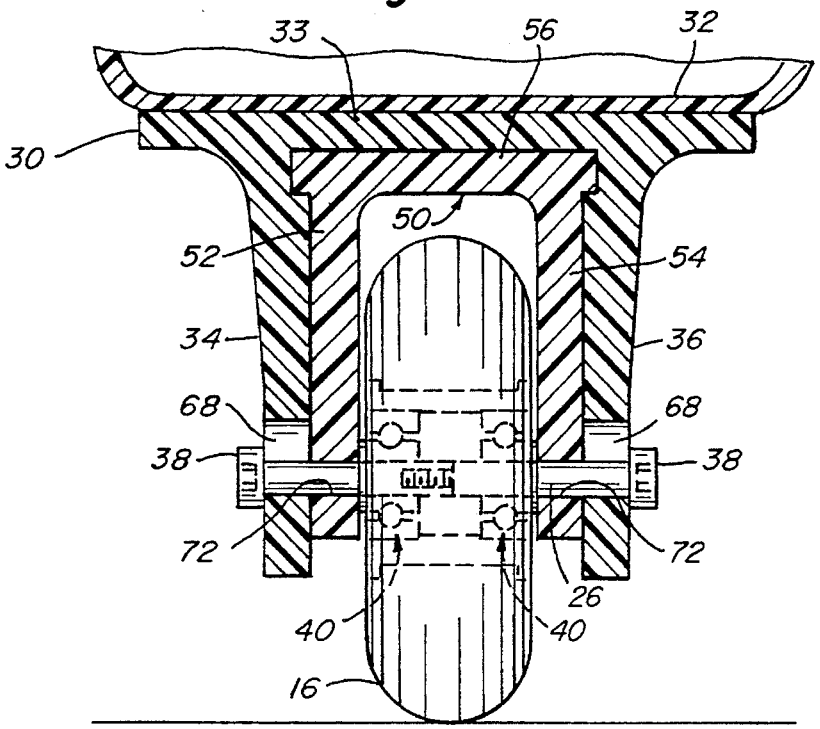
FIG. 2 is a cross-sectional view, taken substantially along the line 2—2 of FIG. 1.

The outer axle support 30, as illustrated in FIG. 2, has a uniform cross section along its length. This cross section includes a bight 33 and a pair of sidewalls 34 and 36, which extend from the bight lengthwise of the skate boot at a uniformly spaced-apart distance. The sidewalls 34 and 36 are formed with aligned openings, through which the axles 22 and 28 extend. These aligned openings should be dimensioned to snugly fit and secure the axles 22 and 28 at their ends by suitable means, such as nuts or flared heads 38 of a split axle. The axles, in turn, support the wheels 12 and 18, which, along with wheels 14 and 16, may be of conventional design and may be supported on their respective axles by standard bearings, illustrated at 40 in FIG. 2. For purposes of assembly, a split axle, as illustrated, may be used if desired.

Positioned within the outer axle support 30 is an inner axle support 50. The inner axle support 50 includes a pair of sidewalls 52 and 54, connected by a bight 56. Sidewalls 52 and 54 are positioned in an adjacent and sliding relationship to the sidewalls 34 and 36. The side edges of bight 56 slide in elongated slots formed within the outer axle support 30. The sidewalls 52 and 54 of the inner axle support are shorter in length than the sidewalls 34 and 36 of the outer axle support, and extend, as illustrated in FIG. 1, only a length sufficient to permit these sidewalls to form supporting elements for the axles 24 and 26. The bight 56, however, as also illustrated in FIG. 1, extends lengthwise beyond the ends of the walls 34 and 36 of the outer axle support, with the extensions of the bight 56 forming kick plates 58 and 60 at the rear and forward ends of the skate, respectively. Unlike the axles 22 and 28 of the outermost wheels, the axles 24 and 26 of the central wheels extend through openings in both the inner and outer axle supports. The openings in the outer axle support, as illustrated at 66 and 68, are vertically elongated slots, with a length at least equal to preferably twice the diameter of the axles themselves. The slots 70 and 72, respectively in the legs 52 and 54, have essentially a Z-shaped or offset section, as illustrated in dotted outline in FIG. 1 and FIG. 3.

In the figure-skating arrangement illustrated in FIG. 1, the centermost wheels are arranged with their axles 24 and 26 extending through the lower ends of the slots 66 and 68 in the outer legs 34 and 36, and in the lower of the offset sections of slots 70 and 72 in the inner axle support 50. Movement of the bight 56 rearwardly, relative to the skate boot 10, will cause the inner axle support 50 to move rearwardly with respect to the outer axle support 30. This relative movement will cause the axles 24 and 26 to move from the left or lower offset sections to the right ends or upper offset sections of the slots 70 and 72 in the inner axle support, and simultaneously upwardly in the slots 66 and 68 in the outer axle support. The net effect of this rearward movement of the bight 56 and the inner axle support relative to the outer causes the centermost wheels 14 and 16 to move upwardly as the inner axle support 50, and consequently the slots 70 and 72, move rearwardly. By proper selections of the slot dimensions, this rearward movement of the inner axle support causes the center wheels 14 and 16 to move into alignment with the forward and rear wheels 12 and 18, as illustrated in FIG. 3.

Rearward and forward movement of the inner axle support 50, relative to the outer axle support 30, may be dynamically effected by kicking one skate boot against the kick plate 58 or 60, depending upon which movement is desired. Thus, to change the orientation of the wheels from a figure-skating orientation, as shown in FIG. 1, to a speed-skating orientation, as shown in FIG. 3, the skater, while skating would kick the kick plate 60 against the back of the other skate boot while in movement. Preferably, this is done by first raising the skate which is to be changed and kicking it against the other skate while it is in ground contact. This causes rearward movement of the inner axle support from the position of FIG. 1 to the position of FIG. 3. The other skate may be similarly kicked immediately thereafter. To reverse the process, the skater kicks the other kick plate 58 on both skates in a similar process, except, of course, using the other ends of the skate.

Figure 6:
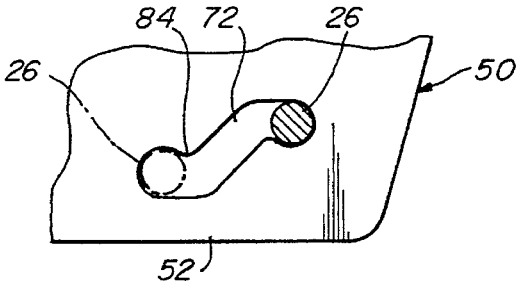
FIG. 6 is a fragmentary elevation of a portion of one axle support, showing a detail of an alternate embodiment.

In order to lock the wheels into the selected position against inadvertent motion, a detent 80, illustrated in FIG. 1, may be used. The detent will, when the skate is in a racing position, engage the detent in the lower surface in the bight forming the outer axle support. Alternately, as illustrated in FIG. 6, the Z-shaped slot in the inner axle support may be provided with an overriding detent 84, which the axle overrides to snap into position.

Having now described my invention, I claim:

1. A first in-line skate having a plurality of aligned wheels and axles therefor, means for selectively shifting and securing the axle of at least one of the plurality of wheels to and from a secured position below the others of said axles of said plurality of wheels, said shifting means including means engageable by a second in-line skate for effecting the shift dynamically as said first skate is in use and moving.

2. A skate as set forth in claim 1 wherein said shifting means includes a frame assembly having a pair of axle supports having aligned openings therein with each of said supports engaging at least one of said axles, means for moving one of said supports relative to the other whereby the relative movement of said supports causes movement of at least one wheel.

3. A skate as set forth in claim 2 wherein said axle supports extend longitudinally of the skate in adjacent sliding relation to one another, with the axles of said at least one of the plurality of wheels extending through aligned openings in the supports.

4. A skate as set forth in claim 3 wherein said openings in one axle support have a different shape from the openings in the other axle support and said axle supports extend longitudinally of said skate with one axle support in longitudinal sliding relation to the other.

5. A skate as set forth in claim 3, wherein said axle supports have openings therein, with an opening in said one axle support comprising a vertical slot and an opening in the other axle support extending longitudinally in said other axle support.

6. A skate as set forth in claim 5 wherein said one axle support is fixed to the bottom of a skate shoe with said vertical slot shaped and sized to permit vertical movement of a wheel axle passing therethrough.

7. A skate as set forth in claim 2 wherein one axle support is fixed to the bottom of said skate shoe and wherein said other axle support is positioned for reciprocal sliding movement longitudinally of said skate shoe and with said opening therein having offset sections with one section offset below the other and shaped to permit movement of an axle from one to the other of said offset sections on relative longitudinal movement of said other axle support.

8. A skate as set forth in claim 7 wherein said other axle support extends beyond the skate shoe at least one end.

9. A skate shoe as set forth in claim 8 wherein axles extend through said openings in said axle support with two axles adapted to be moved in said openings.

* * * * *